US011672383B2

(12) United States Patent
Stanca et al.

(10) Patent No.: US 11,672,383 B2
(45) Date of Patent: Jun. 13, 2023

(54) WET OR DRY PAPER TOWEL DISPENSER

(71) Applicant: Dual Strategies, LLC, Tampa, FL (US)

(72) Inventors: Nicholas Stanca, Westlake, OH (US); Sergey V Makarov, Solon, OH (US); William Sebastian, Northfield, OH (US); David J Boll, Avon, OH (US); Michael Wetzer, Tampa, FL (US)

(73) Assignee: Dual Strategies, LLC, Tampa, FL (US)

( * ) Notice: Subject to any disclaimer, the term of this patent is extended or adjusted under 35 U.S.C. 154(b) by 201 days.

(21) Appl. No.: 17/194,098

(22) Filed: Mar. 5, 2021

(65) Prior Publication Data

US 2022/0279988 A1 Sep. 8, 2022

(51) Int. Cl.
*A47K 10/38* (2006.01)

(52) U.S. Cl.
CPC ..... *A47K 10/38* (2013.01); *A47K 2010/389* (2013.01)

(58) Field of Classification Search
CPC ..... A47K 10/38; A47K 10/3612; A47K 10/3656; A47K 2010/3266; A47K 2010/3273; A47K 2010/3286
See application file for complete search history.

(56) References Cited

U.S. PATENT DOCUMENTS

| | | | | |
|---|---|---|---|---|
| 3,460,509 | A | 8/1969 | Kaczeus | |
| 3,707,945 | A | 1/1973 | Boone | |
| 5,803,397 | A | 1/1998 | Chang | |
| 6,457,434 | B1 * | 10/2002 | Lazar | A47K 10/32 118/325 |
| 7,056,385 | B2 | 6/2006 | Likosar | |
| 7,318,949 | B2 | 1/2008 | Shadrach | |
| 9,532,684 | B2 * | 1/2017 | Hoefte | A47K 10/3836 |
| 9,642,503 | B1 * | 5/2017 | Troutman | A47K 10/36 |
| 9,801,506 | B2 | 10/2017 | Adriaenssens | |
| 10,064,525 | B2 | 9/2018 | Ader | |
| 10,285,544 | B2 | 5/2019 | Perlas | |
| 10,293,353 | B2 | 5/2019 | Casper | |
| 10,588,469 | B2 | 3/2020 | Borke | |
| 2002/0187276 | A1 | 12/2002 | Zhang | |
| 2004/0211229 | A1 | 10/2004 | Ohyama | |

(Continued)

FOREIGN PATENT DOCUMENTS

| | | | |
|---|---|---|---|
| EP | 1938726 | B1 | 9/2010 |
| GB | 1370633 | A | 10/1974 |

(Continued)

*Primary Examiner* — Patrick H Mackey
(74) *Attorney, Agent, or Firm* — Renner, Otto, Boisselle & Sklar, LLP

(57) ABSTRACT

A wet or dry paper towel dispenser may include a housing including a base portion, a paper towel roll holding portion, and a paper towel advancing and wetting portion. The dispenser may also include a paper towel advancing mechanism and a liquid dispensing mechanism at least portion of each disposed in the paper towel advancing and wetting portion. The paper towel advancing mechanism may be configured to receive sheet product of the paper towel roll and advance a portion of the sheet product of the paper towel roll. The liquid dispensing mechanism may be configured to selectively wet the portion of the sheet product of the paper towel roll as the paper towel advancing mechanism advances the portion of the sheet product of the paper roll.

18 Claims, 10 Drawing Sheets

(56) References Cited

U.S. PATENT DOCUMENTS

| | | | | |
|---|---|---|---|---|
| 2007/0272701 | A1 | 11/2007 | Carlsson | |
| 2010/0314429 | A1* | 12/2010 | Troutman | A47K 10/36 225/11 |
| 2020/0154957 | A1* | 5/2020 | Abraham | A47K 10/36 |
| 2022/0346605 | A1* | 11/2022 | Kramer | A47K 10/36 |

FOREIGN PATENT DOCUMENTS

| | | | |
|---|---|---|---|
| GB | 2500282 | A | 9/2013 |
| KR | 10192183581 | | 11/2018 |
| KR | 10195593361 | | 3/2019 |
| KR | 1020200025490 | A | 3/2020 |
| WO | WO2017158244 | A1 | 9/2017 |

* cited by examiner

WET OR DRY PAPER TOWEL DISPENSER

BACKGROUND

Current events make us more aware of germ transmission in all areas of our environment. Exposed surfaces need to be cleaned and disinfected to keep them safe. Paper towels are a mainstay in the surface cleaning landscape. Spraying surfaces with disinfectant and wiping the surfaces clean with paper towels is a well-known method of cleaning. This method, however, is perhaps more practical for cleaning professionals. However, in residential settings and for the lay person in commercial settings, dealing with both a spray bottle and a roll of paper towels is not ideal. The market has attempted to address these concerns by providing paper sheets that are pre-moistened with disinfectants or other fluids. People commonly refer to these pre-moistened sheets as wet wipes.

Various wipe dispensing packages and devices exist that store multiple wet wipes which can be dispensed one at a time by the user. Typically, the wipes are stored in the dispensing device pre-wetted with the fluid. The dispensing device substantially seals to prevent the fluid in the wet wipes from evaporating. While this approach has been satisfactory in some respects, problems nonetheless remain.

The most common problem that arises is the wet wipes drying out. This may occur when the devices or packaging does not seal properly because of failure in design or because of damage during transportation or storage. Drying out of the wet wipes may nevertheless occur over time even if the devices or packaging work properly.

Another common problem is that wipe saturation may not be uniform throughout the packaging and, thus, wipes at the bottom may tend to be wetter while wipes at the top may dry out. Moreover, wet wipes may attach to each other and become inseparable when a user seeks to remove one from the device or packaging; the user would get two or more wet wipes at once. This may be wasteful because wet wipes often cannot or should not go back in the device or packaging. As a result, the user goes through her supply of wet wipes faster than she otherwise should have.

Another common problem is that chemicals in the fluid used to pre-wet the wipes can degrade such that the efficacy of the fluid is reduced, or eliminated, with the passage of time. This is particularly likely to occur in the common circumstance where the wipes are dispensed only occasionally and the wipe fluid thus has a relatively long residence time in the dispenser.

Another problem is that, over time, the fluid and the wipe substrate may chemically interact with each other in such a way that the efficacy of the wipe and/or the fluid is compromised. Again, this problem may be of particular concern in the case where the wipes have a relatively long residence time in the dispenser.

Another problem with typical wipe dispensing systems is that they lack flexibility in terms of the chemical formulations that can be employed. That is, typical wipe dispensing systems are constrained to a limited number of types of chemical formulations for the fluid, since the fluid is required to remain relatively efficacious over a long period of time and cannot have adverse interactions with the wipe substrate material. Corresponding restrictions are imposed on the wipes as well. That is, the wipes must be made of a substrate material that does not significantly degrade when exposed to the fluid for long periods of time.

Typical wipe dispensing systems lack flexibility in other regards as well. For example, it is sometimes the case that a fluid combination is relatively more efficacious than its individual components considered separately. However, such fluid combinations may be efficacious for only a limited period of time. Consequently, it may not be practical to use wipes pre-wetted with such fluid combinations in typical wipe dispensing systems since the fluid on the wipe may reside in the dispensing system for a period of time longer than its useful life.

In light of problems such as those noted above, it would be useful to provide a wipe dispensing system that enables use of various fluids or fluid combinations. It would also be useful to provide a wipe dispensing system that enables relatively long-term storage of the substrate and fluids without material degradation of either.

SUMMARY OF THE INVENTION

The present disclosure provides devices and methods to address these problems. The present disclosure describes a device that takes that most ubiquitous of all cleaning substrates, the standard paper towel, and automatically wets it on-demand just prior to the moment of use. The use of a standard paper towel as the substrate ensures ample supply at relatively low cost. Local wetting of the paper towel to produce an on-demand wet wipe ensures the wet wipe is adequately wet at the time of use; no more dry wipes. The paper towels delivered from a roll also ensures precise delivery of a single paper towel. On-demand wetting of paper towels may also help ensure the used fluids remain at full potency indefinitely or at least for prolonged periods of time as compared to pre-wetted wet wipes. On-demand wetting of paper towels may also help ensure the used fluids do not heavily interact with the paper towel, thereby preserving the efficacy of the paper towel and the fluid.

Keeping the paper towel substrate separate from the fluid increases flexibility because the same paper towel holding device may interchangeably be used to wet the paper towel with various different types of liquids. The devices disclosed herein may even allow for the combination of various fluids to be applied to the paper towel. The disclosed devices may also wet the paper towel taking into account the specific type of paper towel and/or liquid being used to ensure precise dosage and uniform wetness. For example, the disclosed device may automatically read the identity of a liquid to be dispensed and adjust the wetting dosage based on the specifically identified liquid. The devices disclosed herein may also meter paper towel and/or liquid consumption and may communicate electronically to signal for refilling, prior to running out. The devices disclosed herein provide these and other advantages that may become apparent to the person of ordinary skill in the art upon reading of this disclosure.

The accompanying drawings, which are incorporated in and constitute a part of the specification, illustrate various example systems, methods, and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Furthermore, elements may not be drawn to scale.

DETAILED DESCRIPTION

Figure 1A:
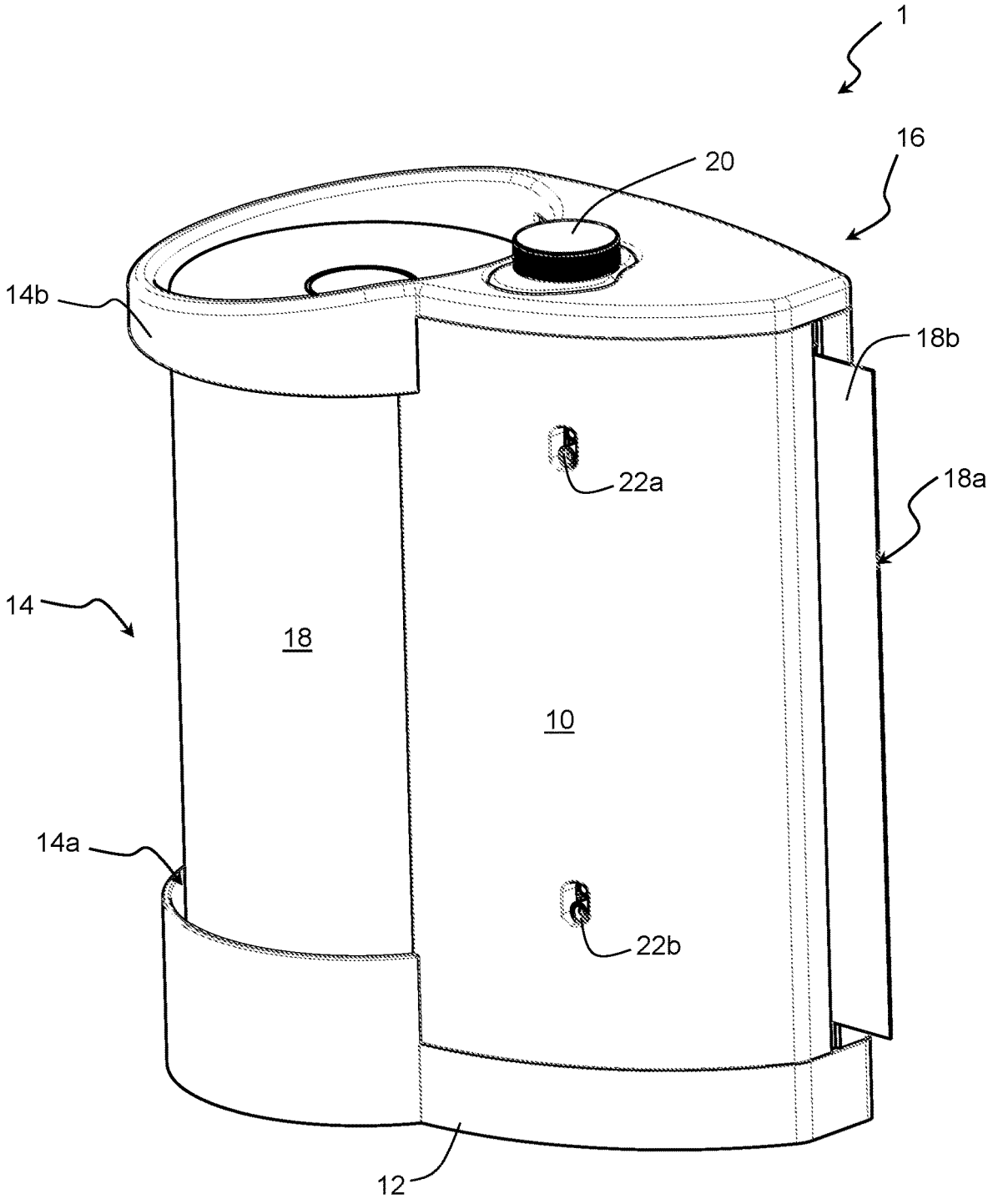
FIGS. 1A and 1B illustrate perspective views of an exemplary wet or dry paper towel dispenser.
Figure 1B:
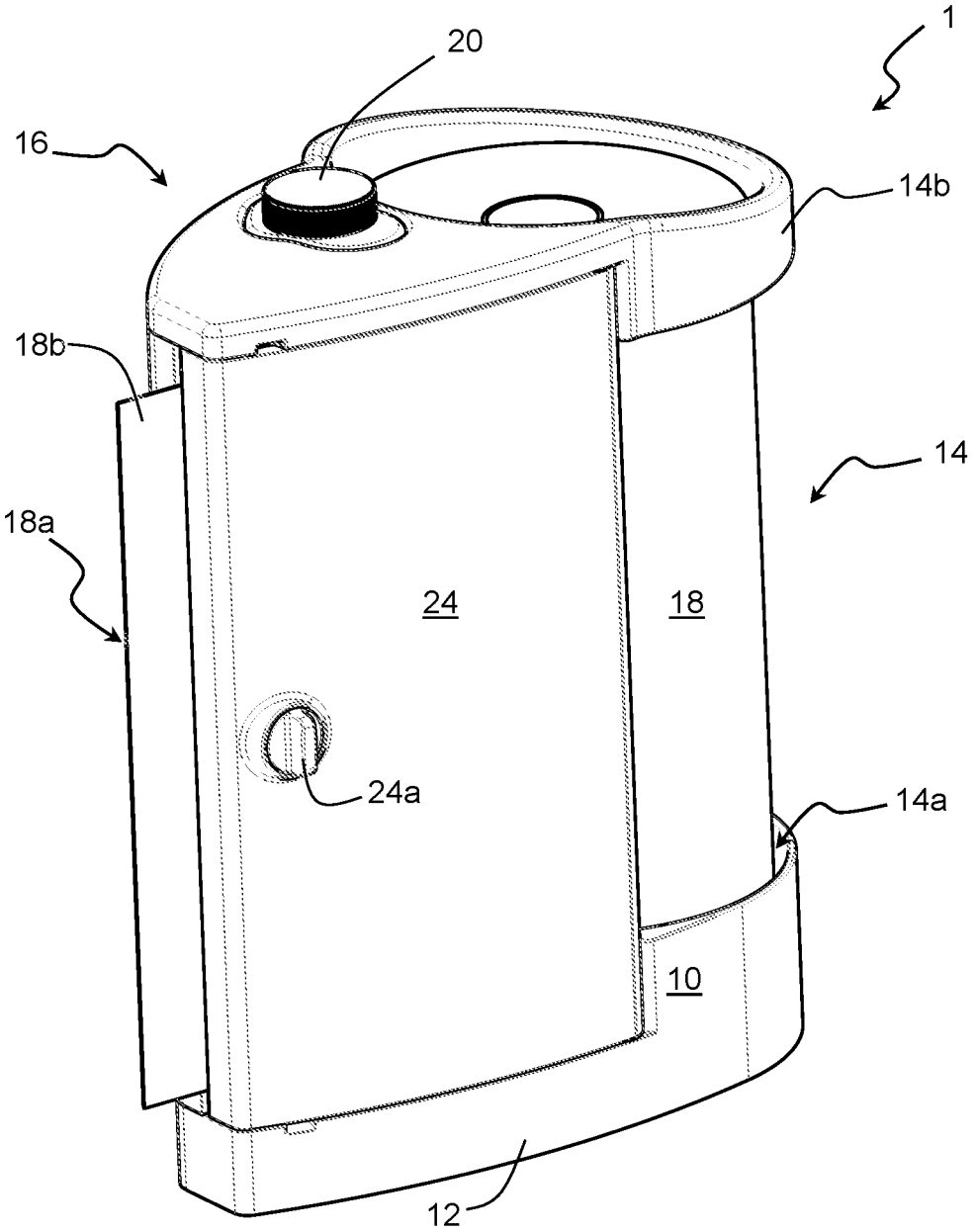
Figure 1C:
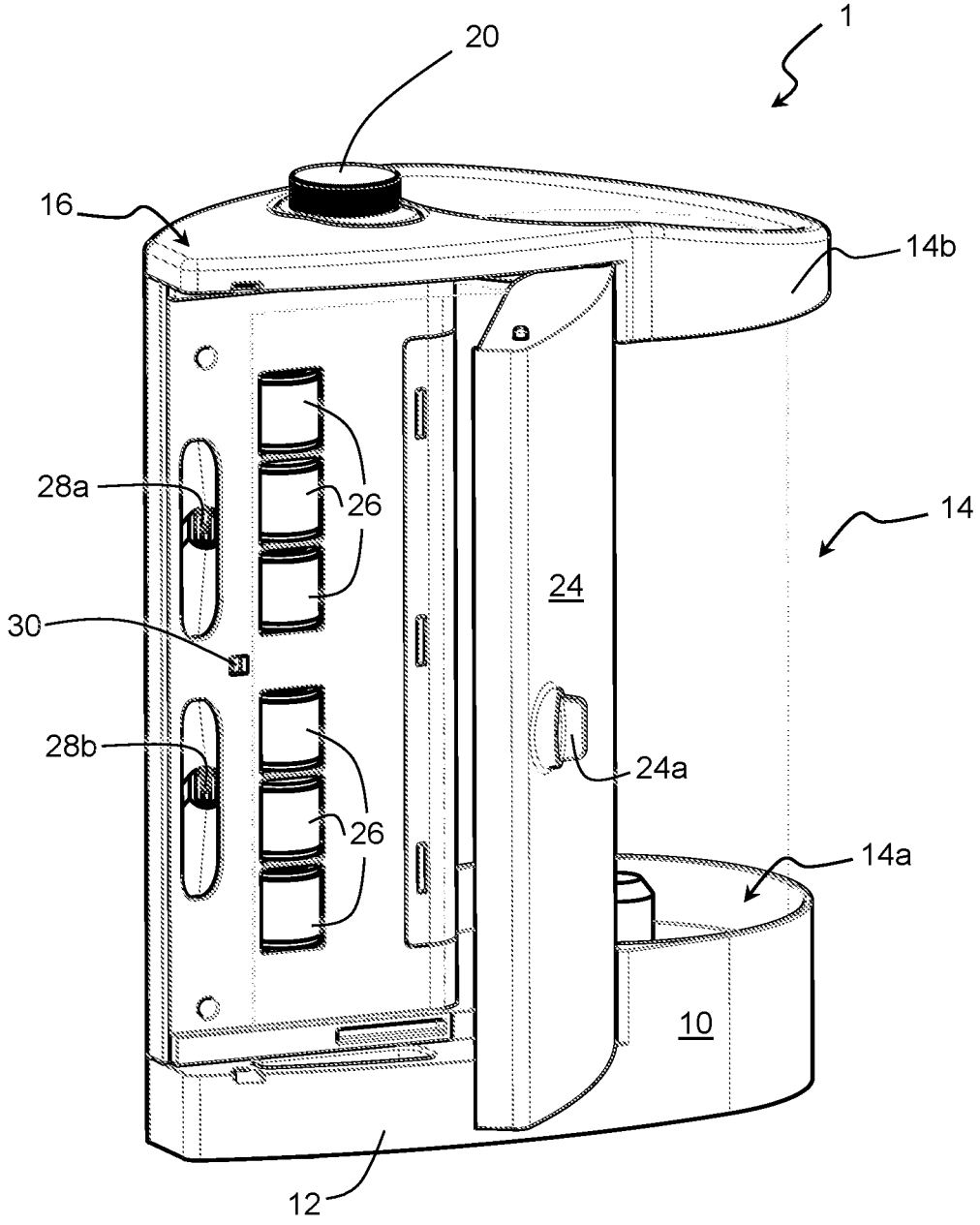
FIG. 1C illustrates a perspective view of the exemplary wet or dry paper towel dispenser with its door open.

FIGS. 1A to 1C illustrate front and back perspective views of an exemplary wet or dry paper towel dispenser 1. The dispenser 1 may include a housing 10 that includes a base 12, a paper towel roll holder 14, and a paper towel advancing and wetting portion 16. The base 12 may support the dispenser 1 on a horizontal surface such as, for example, a kitchen counter or a bathroom vanity. The paper towel roll holder 14 has formed thereon a cylindrical cavity 14*a* corresponding to a diameter of a standard commercial or domestic paper towel roll (e.g., Bounty®). In the illustrated embodiment, the paper towel holder 14 supports a paper towel roll 18 vertically. In other embodiments, the paper towel holder may support a paper towel roll horizontally or in other orientations. In the illustrated embodiment, the paper towel roll holder 14 surrounds less than half the paper towel roll 18 such that more than half the paper towel roll 18 remains visible when installed in the paper towel roll holder 14. In other embodiments, the paper towel roll holder 14 may surround more of the paper towel roll 18. The dispenser 1 may be refilled with the paper towel roll 18 and with liquid used to wet the paper towel roll 18. For this purpose, the dispenser 1 may include a fluid reservoir 20 that holds the liquid.

The dispenser 1 may include a paper towel advancing mechanism that advances the towel paper sheets from the paper towel roll 18 and a liquid dispensing mechanism that wets the towel paper sheets automatically on-demand, just prior to the moment a user would use the wet paper towel.

As described in detail below, the dispenser 1 may include sensors 22*a*, 22*b* that form part of the paper towel advancing mechanism and the liquid dispensing mechanism of the dispenser 1. The sensors 22*a*, 22*b* may detect a user's hand proximate the sensors 22*a*, 22*b* to instruct the dispenser 1 to advance towel paper sheets from the paper towel roll 18. Upon receiving these instructions, the dispenser 1 may dispense a paper towel sheet laterally. In one embodiment, the sensors 22*a* and 22*b* may serve slightly different purposes. For example, detecting the user's hand proximate the sensor 22*a* may cause the dispenser 1 to dispense a paper towel sheet dry while detecting the user's hand proximate the sensor 22*b* may cause the dispenser 1 to wet a paper towel sheet to be delivered and dispense the paper towel sheet wet.

As seen in FIG. 1B, the dispenser 1 may include a cover or door 24 that may include a latch 24*a*. The door 24 may be opened by the latch 24*a* and pulling the door 24 open. Opening the door 24 grants access to some of the paper towel advancing and wetting portion 16. FIG. 10 illustrates the dispenser 1 with the door 24 in the open position.

The paper towel advancing mechanism of the dispenser 1 may include drive rollers 26. The liquid dispensing mechanism of the dispenser may include upper and lower spray nozzles 28*a*, 28*b*. Upon receiving instructions, the paper towel advancing mechanism may drive the rollers 26 to advance a paper towel sheet in contact with the rollers 26. Upon receiving instructions, the liquid dispensing mechanism may also activate the nozzles 28*a*, 28*b* to wet the paper towel sheet to be dispensed. The dispenser 1 may also include an edge detection sensor 30 that detects an edge 18*a* of the paper towel sheet 18*b* of the paper towel roll 18 when the edge 18*a* passes by the edge detection sensor 30.

Figure 2A:
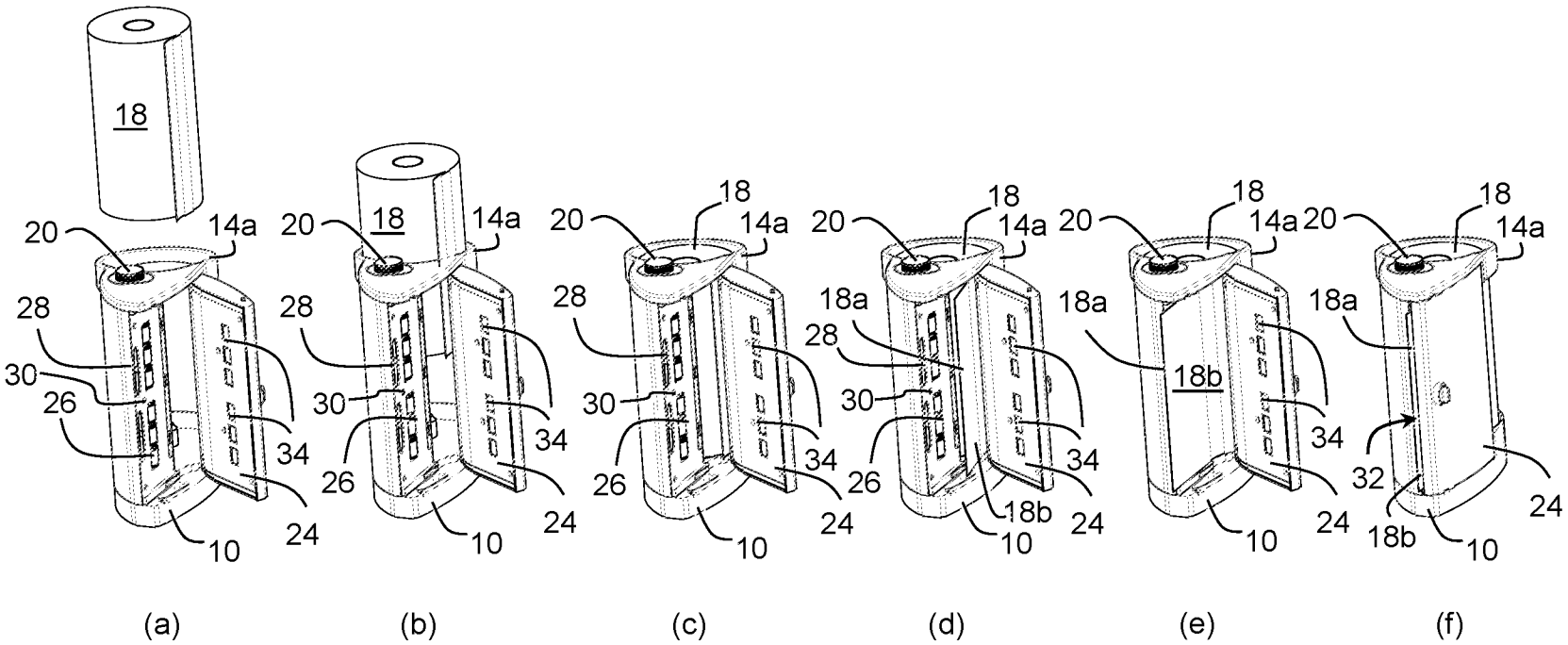
FIGS. 2A and 2B illustrates a method for refilling the exemplary wet or dry paper towel dispenser with a paper towel roll.

FIG. 2A illustrates a method for refilling the dispenser 1 with a paper towel roll 18. At step (a), the door 24 is opened, as described above, and the paper towel roll 18 may be lined up vertically with the cylindrical paper towel roll holder 14, specifically with a top ring 14*a* of the paper towel roll holder 14. At step (b), the paper towel roll 18 may be inserted into the top ring 14*a* of the paper towel roll holder 14. At step (c), the paper towel roll 18 has been inserted into the paper towel roll holder 14. At step (d), the edge 18*a* of the paper towel sheet 18*b* of the paper towel roll 18 may be pulled into the paper towel advancing and wetting portion 16. At step (e), the edge 18*a* of the paper towel sheet 18*b* of the paper towel roll 18 may be further pulled into the paper towel advancing and wetting portion 16 such that the edge 18*a* is laterally beyond the edge of the door 24. The paper towel sheet 18*b* covers the rollers 26 such that, after closing the door 24, the paper towel sheet 18*b* is in contact with the rollers 26 and the paper towel sheet 18*b* further extends such that the edge 18*a* protrudes from the paper dispense opening 32. At step (f), the door 24 may be closed to effectively clamp the paper towel sheet 18*b* inside the paper towel advancing and wetting portion 16 with the edge 18*a* protruding from the paper dispense opening 32.

Figure 2B:
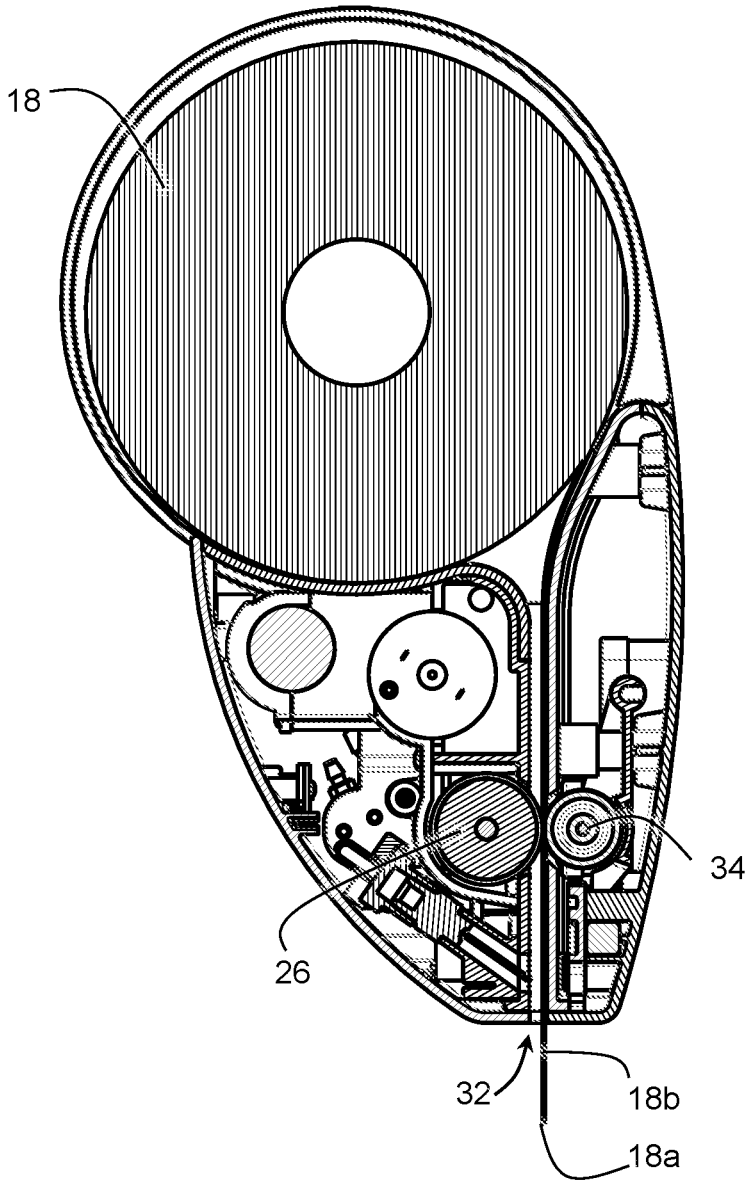

FIG. 2B illustrates a cross-sectional view of the exemplary dispenser 1 in the position (f) of FIG. 2A. The paper towel advancing mechanism may include the primary rollers 26 and secondary rollers 34. The primary rollers 26 are operably connected to a motor while the secondary rollers 34 may free roll. Once the door 24 is closed, the paper towel sheet 18*b* is effectively clamped by primary rollers 26 and secondary rollers 34 with the edge 18*a* protruding from the paper dispense opening 32. The motor may rotate the primary rollers 26 and the secondary rollers 34 may free roll to advance/reverse advancement of the paper towel sheet 18*b*.

In the position (f) of FIG. 2A, the dispenser 1 may detect that the door 24 has been closed and begin a paper towel initialization routine to automatically determine a paper towel sheet size, i.e., the distance between premade perforations. In one embodiment, the paper towel advancing mechanism may include a tachometer to measure length of paper towel advanced. During paper towel installation, the paper towel advancing mechanism may reverse operation to pull in the paper towel edge 18*a* projecting from the paper dispense opening 32 until the edge detection sensor 30 detects the paper towel edge 18*a* that has reentered the dispenser 1. The paper towel advancing mechanism may then advance the paper towel a set length corresponding to a standard longest paper towel sheet size. After a user removes the first paper towel sheet, the paper towel advancing mechanism may then again reverse operation to pull in the paper towel edge 18*a* projecting from the paper dispense opening 32 until the edge detection sensor 30 detects the paper towel edge 18*a*. During reverse operation, the tachometer may measure the actual paper towel sheet size and a processor may calculate the difference between the standard longest paper towel sheet size and the actual paper towel sheet size. Thus, the size of paper towel sheets in the current roll 18 may be determined so that, from this point forward, the paper towel advancing mechanism may advance the exact length of paper towel sheet corresponding to the actual paper towel sheet size.

In one embodiment, the paper towel advancing mechanism using the tachometer or the paper towel perforation detector may determine a length or number of sheets of paper towel that have been used. Based on this information and stored information about the paper towel roll 18 currently installed, the paper towel advancing mechanism or a processor of the dispenser 1 may determine that paper towel sheets have or are about to run out. Refill information may be communicated locally (e.g., local notification) or remotely (e.g., wired, wireless, or Internet signal transmission) to notify a user of the need to refill or replace the paper towel roll 18.

Figure 3A:
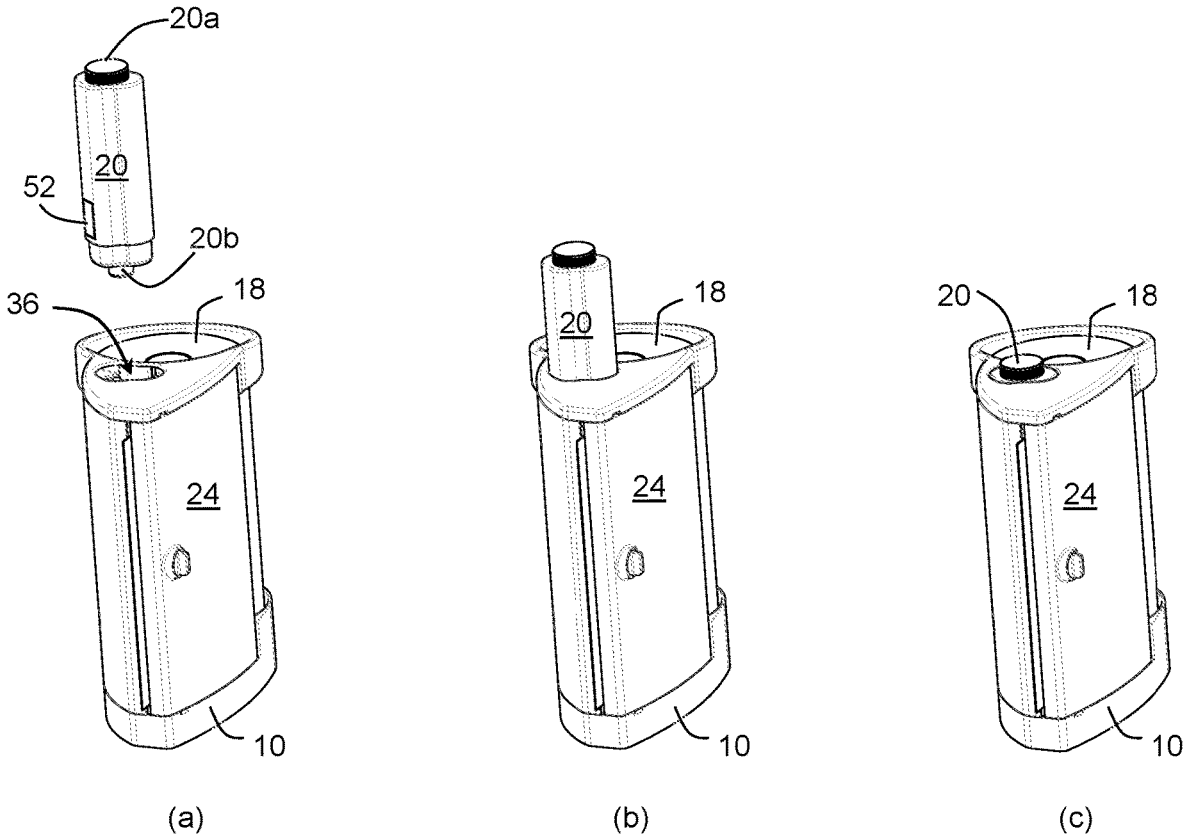
FIGS. 3A and 3B illustrates a method for refilling the exemplary wet or dry paper towel dispenser with a fluid reservoir.

FIG. 3A illustrates a method for refilling or replacing the fluid reservoir 20. At step (a), the fluid reservoir 20 may be lined up with the fluid reservoir holder 36 formed on the housing 10. The fluid reservoir 20 may resemble a bottle with a removable cap 20*a* at one end that may be removed to refill the fluid reservoir 20 with liquid. The other end of the fluid reservoir 20 may have a fluid interface 20*b* that interacts with a fluid interface of the housing 10. At step (b), the fluid reservoir 20 may be inserted into the fluid reservoir holder 36. At step (c), the fluid reservoir 20 has been fully inserted into the fluid reservoir holder 36.

Figure 3B:
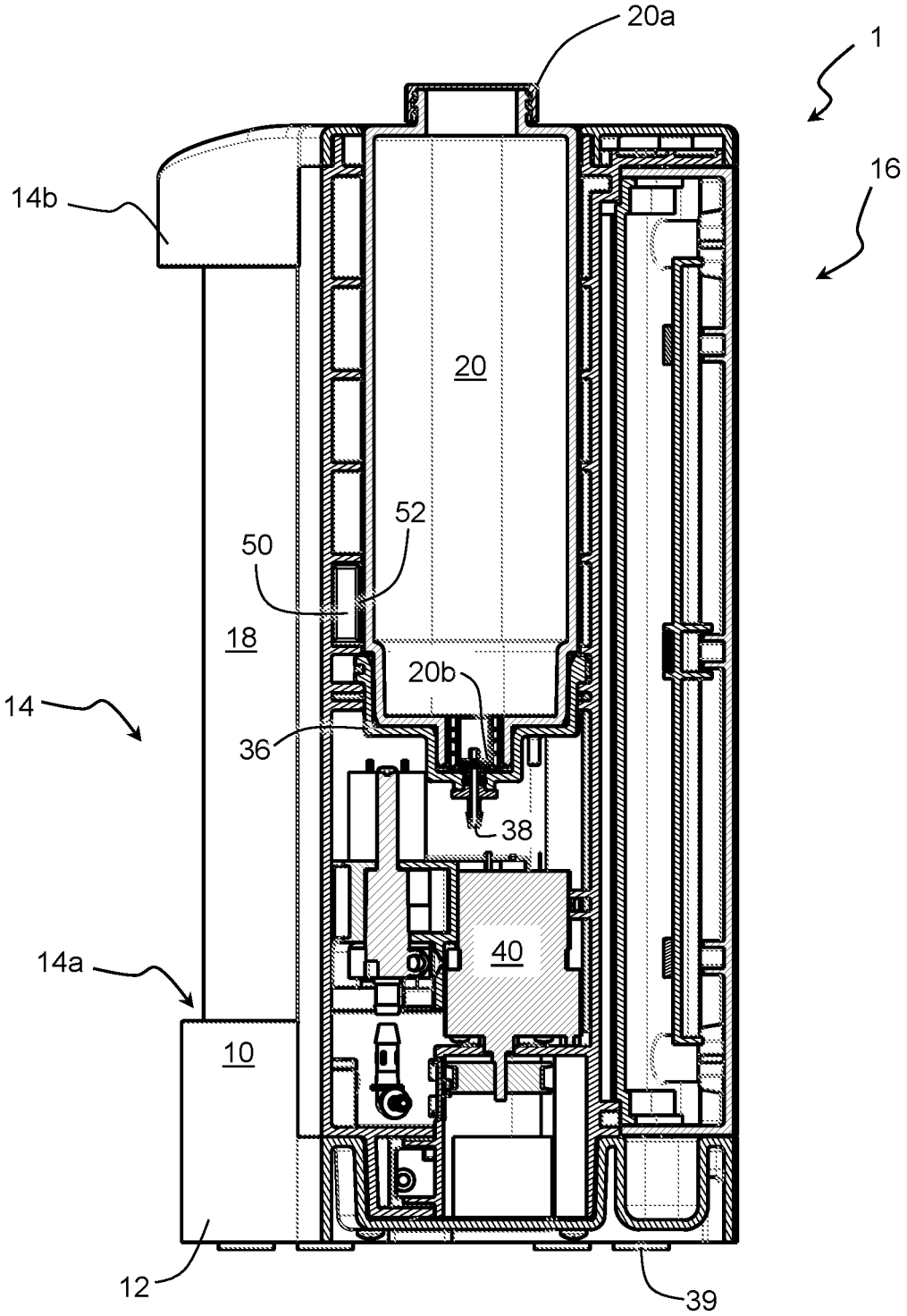

FIG. 3B illustrates a cross-sectional view of the exemplary dispenser 1 in the position (c) of FIG. 3A. In one embodiment, the fluid interface 20*b* of the fluid reservoir 20 includes a self-resealing membrane valve. The liquid dispensing mechanism may include a protruding nozzle 38 configured to perforate the self-resealing membrane valve of the fluid interface 20*b* of the fluid reservoir 20 when it is inserted in the fluid reservoir holder 36. The protruding nozzle 38 perforating the self-resealing membrane valve interface 20*b* effectively fluidly connects the fluid reservoir 20 to the rest of the liquid dispensing mechanism. An advantage of the arrangement in which the protruding nozzle 38 perforates the self-resealing membrane valve interface 20*b* is that the fluid reservoir 20 may be removed from the fluid reservoir holder 36, even while fluid remains in the fluid reservoir 20, without spilling liquid. The self-resealing membrane valve interface 20*b* reseals the fluid reservoir 20 upon removal from the nozzle 38 to prevent spillage.

In one embodiment, the liquid dispensing mechanism includes a fluid reservoir reader 50 disposed in the fluid reservoir holder 36 and the fluid reservoir 20 includes an identification 52 (e.g., QR code, RFID, etc.) such that, when the fluid reservoir 20 is installed in the fluid reservoir holder 36, the fluid reservoir reader 50 may read the identification 52 and, thereby, identify the fluid reservoir 20 or a type of fluid in the fluid reservoir 20. This information might be very useful. For example, the liquid dispending mechanism may select or alter a volume of liquid dispensed per unit time or per paper towel sheet product length based on the identification 52 such that the portion of the sheet product of the paper towel roll receives a first volume of liquid per unit time or per paper towel sheet product length when a first type of liquid is in the fluid reservoir 20 and a second volume of liquid per unit time or per paper towel sheet product length, different from the first volume, when a second type of liquid, different from the first type of liquid, is in the fluid reservoir 20. The identification may also be used to identify necessary labeling (e.g., chemical, FDA) or other characteristics of the fluid (e.g., viscosity) that may be used to inform the user or to operate the dispenser 1 in certain ways based on the fluid.

In another example, the paper towel advancing mechanism may select or alter a rate at which it advances paper towel sheet product based on the identification 52 to, for example, advance a first length of paper towel per unit time when a first liquid type is in the fluid reservoir 20 and a second length of paper towel per unit time, different from the first length, when a second type of liquid, different from the first type of liquid, is in the fluid reservoir 20.

The identification 52 may further be used to verify that the fluid reservoir 20, and thus the fluid therein, are legitimate and/or approved for use in the dispenser 1.

In one embodiment, the fluid dispensing mechanism may use a meter or equivalent (e.g., dry pump detect) to determine a volume of liquid used or remaining in the fluid reservoir 20. Based on this information and/or stored information about the liquid or the fluid reservoir 20 currently installed, the fluid dispensing mechanism may determine that liquid has or is about to run out. Refill information may be communicated locally (e.g., local notification) or remotely (e.g., wired, wireless, or Internet signal transmission) to notify a user of the need to refill or replace the fluid reservoir 20.

FIG. 3B further illustrates that the dispenser 1 may include rubber feet 39 or similar to prevent the dispenser 1 from sliding on the horizontal surface on which it rests.

Figure 4:
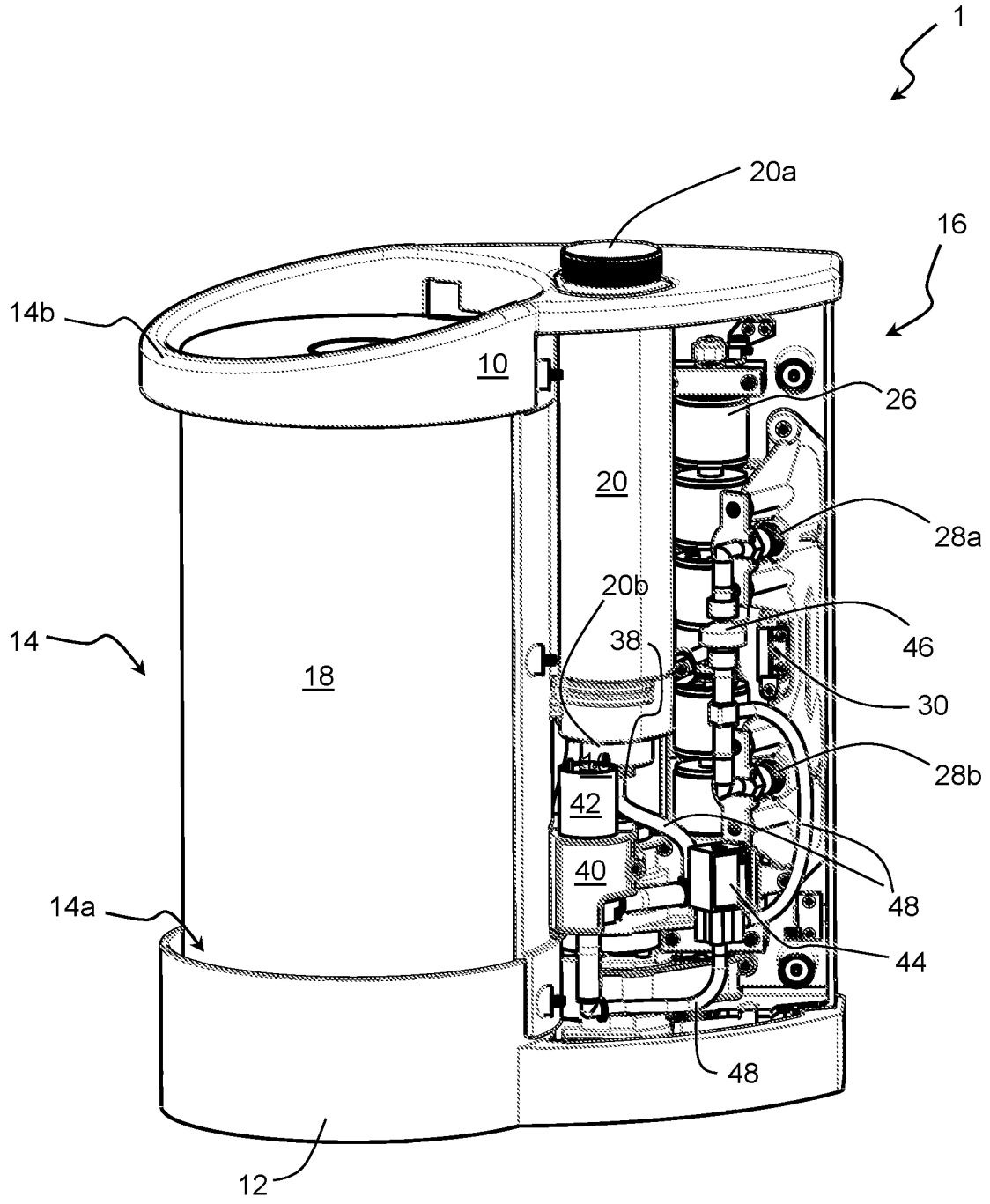
FIG. 4 illustrates a perspective view of the exemplary wet or dry paper towel dispenser with its front cover removed.

FIG. 4 illustrates the dispenser 1 with the front cover removed to expose interior parts of the paper towel advancing and wetting portion 16. The dispenser's paper towel advancing mechanism may include the edge sensor 30, and a motor 40 that is operably connected (e.g., gears, belts, etc.) to the primary rollers 26. Operation of the motor 40, after detection by the sensors 22*a*, 22*b*, causes the primary rollers 26 to rotate. The dispenser's liquid dispensing mechanism may include the fluid reservoir 20 with its valve interface 20*b* connected to the nozzle 38. The liquid dispensing mechanism may further include a pump 42, a solenoid valve 44, a check (one way) valve 46, and the upper and lower nozzles 28*a*, 28*b*. Tubing 48 may connect the fluid reservoir 20 to the pump 42, the solenoid valve 44, the check valve 46, and to the upper and lower nozzles 28*a*, 28*b*. Operation of the pump 42 and the solenoid valve 44 causes liquid to flow from the fluid reservoir 20 and spray from the upper and lower nozzles 28*a*, 28*b*. The upper and lower nozzles 28*a*, 28*b* are vertically spaced from each other and horizontally spaced from the towel paper such that the nozzles 28*a*, 28*b* spray the towel paper generally evenly with the upper nozzle 28*a* spraying a top portion of the towel paper sheet 18*b* and the lower nozzle 28*b* spraying a bottom portion of the towel paper sheet 18*b*.

Figure 5:
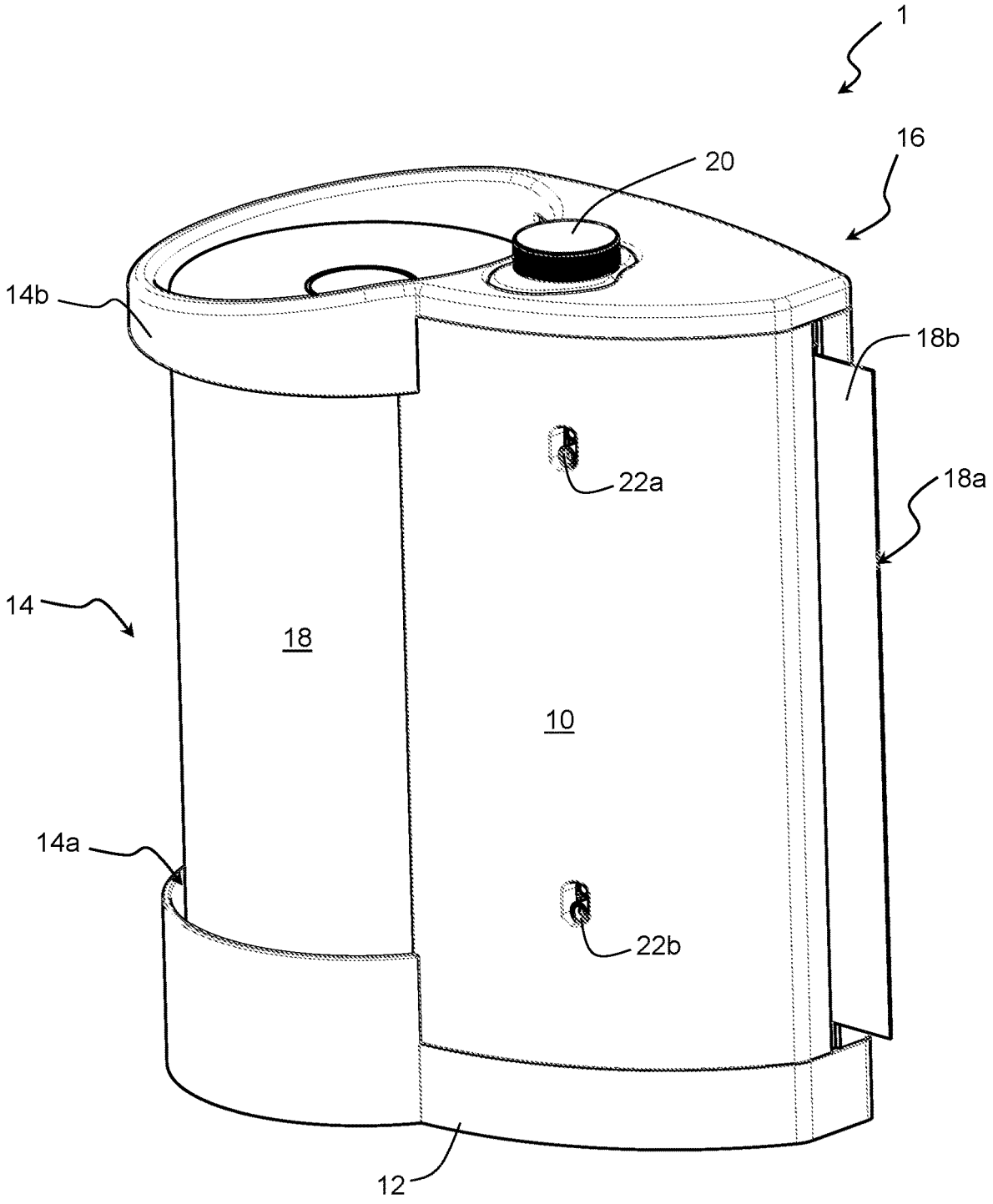
FIG. 5 illustrates a perspective views of the exemplary wet or dry paper towel dispenser in steady state.

FIG. 5 illustrates the dispenser 1 in steady state, ready for operation. A user may place her hand proximate the sensor 22*a* to dispense a dry paper towel sheet. The sensor 22*a* senses the hand and sends a signal to a controller or processor which activates the motor 40 to rotate the primary rollers 26. The primary rollers 26 rotate and the towel paper, clamped between the primary rollers 26 and the free rolling secondary rollers 34, advances to be dispensed from the dispense opening 32.

In the alternative, the user may place her hand proximate the sensor 22*b* to dispense a wet paper towel sheet. The sensor 22*b* senses the hand and sends a signal to the controller or processor which activates the motor 40 to rotate the primary rollers 26 and the pump 42 and the solenoid valve 44 to spray liquid from the upper and lower nozzles 28*a*, 28*b*. The nozzles 28*a*, 28*b* spray the paper towel sheet while the primary rollers 26 rotate and the wet towel paper advances to be dispensed from the dispense opening 32.

In one embodiment, the paper towel advancing mechanism may include a paper towel sheet jam detection mechanism. In one embodiment, the paper towel sheet jam detection mechanism may include measuring current to the motor 40 to go over a threshold indicating that the motor 40 is overworked and interpreting such overwork as a paper towel sheet jam. In another embodiment, the paper towel sheet jam detection mechanism may include the tachometer not changing state while the motor 40 is operating or the tachometer detecting paper advancement different from what would be expected in view of the rotation of the motor 40. A detected paper towel sheet jam may be communicated locally (e.g., local alarm) or remotely (e.g., wired, wireless, or Internet signal transmission) to notify a user to clear the paper towel sheet jam.

Figure 6:
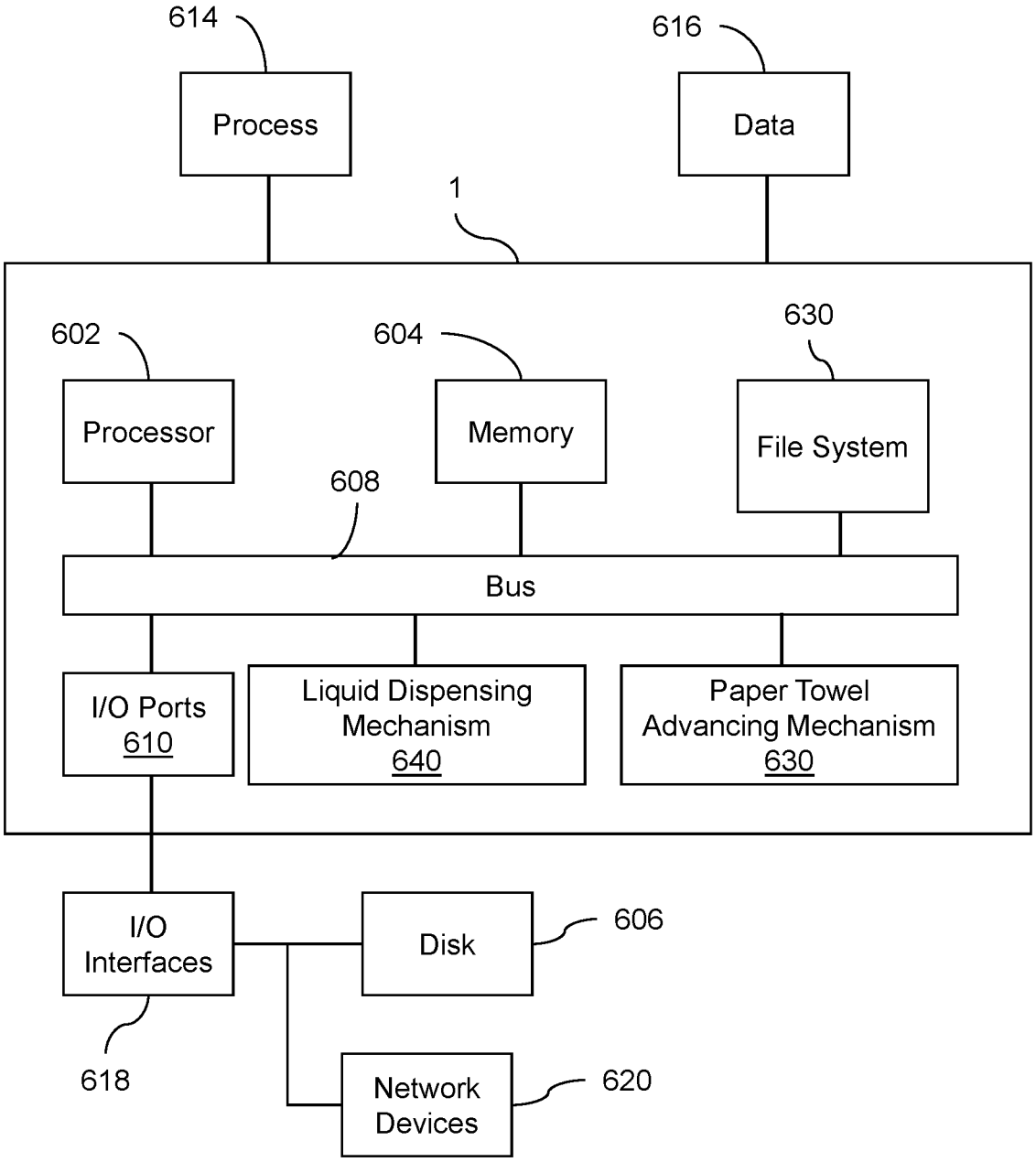
FIG. 6 illustrates a block diagram of the exemplary wet or dry paper towel dispenser.

FIG. 6 illustrates a block diagram of an exemplary wet or dry paper towel dispenser 1. The dispenser 1 may include a processor 602, a memory 604, and I/O Ports 610 operably connected by a bus 608.

In one example, the dispenser 1 may receive input signals via, for example, I/O Ports 610 or I/O Interfaces 618 to, for example, change parameters regarding a paper towel roll 18 installed in the paper towel roll holder 14 or liquid in the fluid reservoir 20. The dispenser 1 may also include the paper towel advancing mechanism 630, which includes the sensors 22*a*, 22*b*, the edge sensor 30, and the motor 40. The dispenser 1 may also include the liquid dispensing mechanism 640, which includes the fluid reservoir 20, the pump 42, the solenoid valve 44, the check valve 46, the upper and lower nozzles 28*a*, 28*b*, and the identification reader 50. Thus, the paper towel advancing mechanism 630 and the liquid dispensing mechanism 640 may be implemented in dispenser 1 as hardware, firmware, software, or a combination thereof and, thus, the dispenser 1 and its components as disclosed herein may provide means for performing functions described and/or claimed herein as performed by the paper towel advancing mechanism 630 and the liquid dispensing mechanism 640.

The processor 602 can be a variety of various processors including dual microprocessor and other multi-processor architectures. The memory 604 can include volatile memory or non-volatile memory. The non-volatile memory can include, but is not limited to, ROM, PROM, EPROM, EEPROM, and the like. Volatile memory can include, for example, RAM, synchronous RAM (SRAM), dynamic RAM (DRAM), synchronous DRAM (SDRAM), double data rate SDRAM (DDR SDRAM), and direct RAM bus RAM (DRRAM).

A drive 606 may be operably connected to the dispenser 1 via, for example, an I/O interfaces (e.g., card, device) 618 and an I/O Ports 610. The drive 606 can include, but is not limited to, devices like a magnetic disk drive, a solid-state drive, a flash memory card, or a memory stick. Furthermore, the drive 606 can include optical drives like a CD-ROM, a CD recordable drive (CD-R drive), a CD rewriteable drive (CD-RW drive), or a digital video ROM drive (DVD ROM). The memory 604 can store processes 614 or data 616, for example. The drive 606 or memory 604 can store an operating system that controls and allocates resources of the dispenser 1.

The bus 608 can be a single internal bus interconnect architecture or other bus or mesh architectures. While a single bus is illustrated, it is to be appreciated that dispenser 1 may communicate with various devices, logics, and peripherals using other busses that are not illustrated (e.g., PCIE, SATA, Infiniband, 1394, USB, Ethernet). The bus 608 can be of a variety of types including, but not limited to, a memory bus or memory controller, a peripheral bus or external bus, a crossbar switch, or a local bus. The local bus can be of varieties including, but not limited to, an industrial standard architecture (ISA) bus, a microchannel architecture (MCA) bus, an extended ISA (EISA) bus, a peripheral component interconnect (PCI) bus, a universal serial (USB) bus, and a small computer systems interface (SCSI) bus.

The dispenser 1 may interact with input/output devices via I/O Interfaces 618 and I/O Ports 610. Input/output devices can include, but are not limited to, a keyboard, a microphone, a pointing and selection device, cameras, video cards, displays, drive 606, network devices 620, and the like. The I/O Ports 610 can include but are not limited to, serial ports, parallel ports, and USB ports.

The dispenser 1 can operate in a network environment and thus may be connected to network devices 620 via the I/O Interfaces 618, or the I/O Ports 610. Through the network devices 620, the dispenser 1 may interact with a network. Through the network, the dispenser 1 may be logically connected to remote computers. The networks with which the dispenser 1 may interact include, but are not limited to, a local area network (LAN), a wide area network (WAN), and other networks. The network devices 620 can connect to LAN technologies including, but not limited to, fiber distributed data interface (FDDI), copper distributed data interface (CDDI), Ethernet (IEEE 802.3), token ring (IEEE 802.5), wireless computer communication (IEEE 802.11), Bluetooth (IEEE 802.15.1), Zigbee (IEEE 802.15.4) and the like. Similarly, the network devices 620 can connect to WAN technologies including, but not limited to, point to point links, circuit switching networks like integrated services digital networks (ISDN), packet switching networks, and digital subscriber lines (DSL). While individual network types are described, it is to be appreciated that communications via, over, or through a network may include combinations and mixtures of communications.

Thus, the network devices 620 via the I/O Interfaces 618, or the I/O Ports 610 may serve for the dispenser 1 to form part of an Internet-of-Things (IOT) network in which the dispenser 1 may participate to communicate paper towel or fluid reservoir refill information, paper towel sheet jam information, liquid type information, paper towel or fluid usage information, and other types of information as described herein and beyond.

Definitions

The following includes definitions of selected terms employed herein. The definitions include various examples or forms of components that fall within the scope of a term and that may be used for implementation. The examples are not intended to be limiting. Both singular and plural forms of terms may be within the definitions.

"Data store" or "database," as used herein, refers to a physical or logical entity that can store data. A data store may be, for example, a database, a table, a file, a list, a queue, a heap, a memory, a register, and so on. A data store may reside in one logical or physical entity or may be distributed between two or more logical or physical entities.

"Logic," as used herein, includes but is not limited to hardware, firmware, software, or combinations of each to perform a function(s) or an action(s), or to cause a function or action from another logic, method, or system. For example, based on a desired application or needs, logic may include a software-controlled microprocessor, discrete logic like an application specific integrated circuit (ASIC), a programmed logic device, a memory device containing instructions, or the like. Logic may include one or more gates, combinations of gates, or other circuit components. Logic may also be fully embodied as software. Where multiple logical logics are described, it may be possible to incorporate the multiple logical logics into one physical logic. Similarly, where a single logical logic is described, it may be possible to distribute that single logical logic between multiple physical logics.

An "operable connection," or a connection by which entities are "operably connected," is one in which signals, physical communications, or logical communications may be sent or received. Typically, an operable connection includes a physical interface, an electrical interface, or a data interface, but it is to be noted that an operable connection may include differing combinations of these or other types of connections sufficient to allow operable control. For example, two entities can be operably connected by being able to communicate signals to each other directly or through one or more intermediate entities like a processor, operating system, a logic, software, or other entity. Logical or physical communication channels can be used to create an operable connection.

"Signal," as used herein, includes but is not limited to one or more electrical or optical signals, analog or digital signals, data, one or more computer or processor instructions, messages, a bit or bit stream, or other means that can be received, transmitted, or detected.

"Software," as used herein, includes but is not limited to, one or more computer or processor instructions that can be read, interpreted, compiled, or executed and that cause a computer, processor, or other electronic device to perform functions, actions or behave in a desired manner. The instructions may be embodied in various forms like routines, algorithms, modules, methods, threads, or programs including separate applications or code from dynamically or statically linked libraries. Software may also be implemented in a variety of executable or loadable forms including, but not limited to, a stand-alone program, a function call (local or remote), a servlet, an applet, instructions stored in a memory, part of an operating system or other types of executable instructions. It will be appreciated by one of ordinary skill in the art that the form of software may depend, for example, on requirements of a desired application, the environment in which it runs, or the desires of a designer/programmer or the like. It will also be appreciated that computer-readable or executable instructions can be located in one logic or distributed between two or more communicating, co-operating, or parallel processing logics and thus can be loaded or executed in serial, parallel, massively parallel and other manners.

Suitable software for implementing the various components of the example systems and methods described herein may be produced using programming languages and tools like Java, Pascal, C#, C++, C, CGI, Perl, SQL, APIs, SDKs, assembly, firmware, microcode, or other languages and tools. Software, whether an entire system or a component of a system, may be embodied as an article of manufacture and maintained or provided as part of a computer-readable medium as defined previously. Another form of the software may include signals that transmit program code of the software to a recipient over a network or other communication medium. Thus, in one example, a computer-readable medium has a form of signals that represent the software/firmware as it is downloaded from a web server to a user. In another example, the computer-readable medium has a form of the software/firmware as it is maintained on the web server. Other forms may also be used.

"User" or "consumer," as used herein, includes but is not limited to one or more persons, software, computers or other devices, or combinations of these.

Some portions of the detailed descriptions that follow are presented in terms of algorithms and symbolic representations of operations on data bits within a memory. These algorithmic descriptions and representations are the means used by those skilled in the art to convey the substance of their work to others. An algorithm is here, and generally, conceived to be a sequence of operations that produce a result. The operations may include physical manipulations of physical quantities. Usually, though not necessarily, the physical quantities take the form of electrical or magnetic signals capable of being stored, transferred, combined, compared, and otherwise manipulated in a logic and the like.

It has proven convenient at times, principally for reasons of common usage, to refer to these signals as bits, values, elements, symbols, characters, terms, numbers, or the like. It should be borne in mind, however, that these and similar terms are to be associated with the appropriate physical quantities and are merely convenient labels applied to these quantities. Unless specifically stated otherwise, it is appreciated that throughout the description, terms like processing, computing, calculating, determining, displaying, or the like, refer to actions and processes of a computer system, logic, processor, or similar electronic device that manipulates and transforms data represented as physical (electronic) quantities.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995).

While example systems, methods, and so on, have been illustrated by describing examples, and while the examples have been described in considerable detail, it is not the intention of the applicants to restrict or in any way limit scope to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, the representative apparatus, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A wet or dry paper towel dispenser, comprising:

a housing including a base portion, a paper towel roll holding portion, and a paper towel advancing and wetting portion, wherein the paper towel roll holding portion is configured to support a paper towel roll vertically;

a paper towel advancing mechanism and a liquid dispensing mechanism at least portion of each disposed in the paper towel advancing and wetting portion, the paper towel advancing mechanism configured to receive sheet product of the paper towel roll and advance a portion of the sheet product of the paper towel roll laterally, the liquid dispensing mechanism configured to selectively wet the portion of the sheet product of the paper towel roll as the paper towel advancing mechanism advances the portion of the sheet product of the paper roll laterally;

a liquid dispensing mechanism inludes a fluid reservoir and the housing includes a fluid reservoir holding portion configured to removable receive the fluid reservoir to fluidly connect the fluid reservoir to the rest of the liquid dispending mechanism, the fluid reservoir holding portion including a fluid reservoir reader and the fluid reservoir including an identification such that, when the fluid reservoir is installed in the fluid reservoir holding portion, the fluid reservoir reader reads the identification and, thereby, identify a type of fluid in the fluid reservoir.

2. The wet or dry paper towel dispenser of claim 1, wherein the paper towel roll holding portion has formed thereon a cylindrical cavity corresponding to a diameter of a commercial or domestic paper towel roll.

3. The wet or dry paper towel dispenser of claim 1, wherein the paper towel roll holding portion has formed thereon a cylindrical cavity corresponding to a diameter of a commercial or domestic paper towel roll, the paper towel roll insertable into the cavity vertically.

4. The wet or dry paper towel dispenser of claim 1, wherein the paper towel roll holding portion has formed thereon a cylindrical cavity corresponding to a diameter of a commercial or domestic paper towel roll, the paper towel roll holding portion surrounding less than half the paper towel roll such that more than half the paper towel roll remains visible when installed in the paper towel roll holding portion.

5. The wet or dry paper towel dispenser of claim 1, wherein the paper towel advancing and wetting portion has a cover, wherein the cover is movable relative to the base portion to define an open position and a closed position, in the open position at least a portion of the paper towel advancing mechanism is exposed to, during installation, manually advance a leading edge of the sheet product of the paper towel roll, and in the closed position the paper towel advancing mechanism clamps at least part of the portion of the sheet product of the paper towel roll adjacent the leading edge.

6. The wet or dry paper towel dispenser of claim 1, wherein the paper towel advancing and wetting portion includes a plurality of nozzles fluidly connected to a fluid reservoir, a first nozzle from the plurality of nozzles disposed vertically above a second nozzle from the plurality of nozzles such that the first nozzle is configured to wet a first part of the portion of the sheet product of the paper towel roll and the second nozzle is configured to wet a second part of the portion of the sheet product of the paper towel roll as the paper towel advancing mechanism advances the portion of the sheet product of the paper roll laterally, the first part is vertically above the second part.

7. The wet or dry paper towel dispenser of claim 1, comprising:

one or more sensors operably connected to the paper towel advancing mechanism and configured to detect a user's hand proximate the one or more sensors, the paper towel advancing mechanism configured to advance the portion of the sheet product of the paper roll laterally upon detection of the user's hand proximate the one or more sensors.

8. The wet or dry paper towel dispenser of claim 1, comprising:

one or more sensors operably connected to the paper towel advancing mechanism and the liquid dispensing mechanism and configured to detect a user's hand proximate the one or more sensors, the paper towel advancing mechanism configured to advance the portion of the sheet product of the paper roll laterally upon detection of the user's hand proximate at least one of the one or more sensors, the liquid dispensing mechanism configured to dispense fluid upon the portion of the sheet product of the paper roll upon detection of the user's hand proximate one of the one or more sensors but not another of the one or more sensors.

9. The wet or dry paper towel dispenser of claim 1, wherein the liquid dispensing mechanism includes a fluid reservoir and the housing includes a fluid reservoir holding portion, the fluid reservoir having a self-resealing membrane interface and the fluid reservoir holding portion has a protruding nozzle configured to perforate the self-resealing membrane interface when the fluid reservoir is inserted in the fluid reservoir holding portion.

10. The wet or dry paper towel dispenser of claim 1, wherein the liquid dispending mechanism configured to select or alter a volume of liquid dispensed per unit time or per sheet product length based on the identification such that the portion of the sheet product of the paper towel roll receives a first volume of liquid per unit time or per sheet product length when a first liquid is in the fluid reservoir and a second volume of liquid per unit time or per sheet product length, different from the first volume, when a second liquid, different from the first liquid, is in the fluid reservoir, or the paper towel advancing mechanism configured to select or alter a rate at which sheet product is advanced based on the identification such that the portion of the sheet product of the paper towel advances a first length per unit time when a first liquid is in the fluid reservoir and a second length per unit time, different from the first length, when a second liquid, different from the first liquid, is in the fluid reservoir.

11. The wet or dry paper towel dispenser of claim 1, wherein the paper towel advancing mechanism includes a paper towel size determining mechanism including a paper towel edge detector and a paper towel meter, the paper towel advancing mechanism configured to reverse sheet product previously advanced until the paper towel edge detector detects and edge of the sheet product, the paper towel meter metering a length of sheet product advanced, the paper towel size determining mechanism determining a size of the sheet product based on the edge detection and the metered length of the sheet product.

12. The wet or dry paper towel dispenser of claim 1, wherein the paper towel advancing mechanism includes a paper towel sheet jam detection mechanism.

13. The wet or dry paper towel dispenser of claim 1, comprising a processor and communication hardware, wherein the paper towel advancing mechanism includes at least one of a paper towel sheet jam detection mechanism and a sheet product metering mechanism operably connected to the processor, the processor configured to utilize the communication hardware to communicate a paper towel sheet jam or a sheet product low signal based on the respective detection or metering, or the liquid dispending mechanism includes at least one of a liquid reservoir type (chemical , etc.) detecting mechanism and a liquid metering mechanism operably connected to the processor, the processor configured to utilize the communication hardware to communicate a liquid type or a liquid product low signal based on the respective detection or metering.

14. The wet or dry paper towel dispenser of claim1, comprising:

a processor and an IOT interface, wherein the paper towel advancing mechanism includes at least one of a paper towel sheet jam detection mechanism and a sheet product metering mechanism operably connected to the processor, the processor configured to utilize the IOT interface to communicate a paper towel sheet jam or a sheet product low signal based on the respective detection or metering, or the liquid dispending mechanism includes at least one of a liquid reservoir type detecting mechanism and a liquid metering mechanism operably connected to the processor, the processor configured to utilize the IOT interface to communicate a liquid type or a liquid product low signal based on the respective detection or metering.

15. A wet or dry paper towel dispenser, comprising:

a housing including a base portion and a paper towel roll holding portion;

a liquid dispensing mechanism configured to wet a portion of sheet product of the paper towel roll as the portion of the sheet product of the paper roll advances; the liquid dispensing mechanism includes a fluid reservoir and the housing includes a fluid reservoir holding portion configured to removable receive the fluid reservoir to fluidly connect the fluid reservoir to the rest of the liquid dispensing mechanism, the fluid reservoir holding portion including a fluid reservoir reader and the fluid reservoir including an identification such that, when the fluid reservoir is installed in the fluid reservoir holding portion, the fluid reservoir reader reads the identification, wherein the liquid dispending mechanism is configured to select or alter a volume of liquid dispensed per unit time or per sheet product length based on the identification such that the portion of the sheet product of the paper towel roll receives a first volume of liquid per unit time or per sheet product length when a first liquid is in the fluid reservoir and a second volume of liquid per unit time or per sheet product length, different from the first volume, when a second liquid, different from the first liquid, is in the fluid reservoir.

16. The wet or dry paper towel dispenser of claim 15, comprising:

a paper towel advancing and wetting portion within which at least a portion of the liquid dispensing mechanism is disposed;

a paper towel advancing mechanism at least a portion of which is disposed in the paper towel advancing and wetting portion, the paper towel advancing mechanism configured to receive sheet product of the paper towel roll and advance a portion of the sheet product of the paper towel roll, the liquid dispensing mechanism configured to selectively wet the portion of the sheet product of the paper towel roll as the paper towel advancing mechanism advances the portion of the sheet product of the paper roll.

17. The wet or dry paper towel dispenser of claim 15, comprising:

a paper towel advancing and wetting portion within which at least a portion of the liquid dispensing mechanism is disposed;

a paper towel advancing mechanism at least a portion of which is disposed in the paper towel advancing and wetting portion, the paper towel advancing mechanism configured to receive sheet product of the paper towel roll and advance a portion of the sheet product of the paper towel roll, the liquid dispensing mechanism configured to selectively wet the portion of the sheet product of the paper towel roll as the paper towel advancing mechanism advances the portion of the sheet product of the paper roll, wherein the paper towel advancing mechanism is configured to select or alter a rate at which sheet product is advanced based on the identification such that the portion of the sheet product of the paper towel advances a first length per unit time when a first liquid is in the fluid reservoir and a second length per unit time, different from the first length, when a second liquid, different from the first liquid, is in the fluid reservoir.

18. The wet or dry paper towel dispenser of claim 15, comprising:

a processor operably connected to the liquid dispending mechanism and an IOT interface operably connected to the processor, wherein the processor is configured to utilize the IOT interface to communicate the information or other information relating to the liquid dispensing mechanism or the wet or dry paper towel dispenser.

* * * * *